US005461750A

United States Patent [19]

Kaiser

[11] Patent Number: 5,461,750

[45] Date of Patent: Oct. 31, 1995

[54] DOUBLE CURVED BACKING PLATE WITH CUSHIONED SUPPORT FOR ROTARY BUFFING PADS

[76] Inventor: Richard A. Kaiser, N84 W28518 Center Oak Rd., Hartland, Wis. 53029

[21] Appl. No.: 382,626

[22] Filed: Feb. 2, 1995

[51] Int. Cl.[6] ..... B24D 13/14

[52] U.S. Cl. ..... 15/230; 15/230.12; 15/230.17

[58] Field of Search ..... 15/97.1, 98, 230, 15/230.12, 230.15, 230.17, 230.18, 230.19

[56] References Cited

U.S. PATENT DOCUMENTS

| | | | |
|---|---|---|---|
| 1,998,244 | 4/1935 | Lang | 15/230.19 |
| 3,007,189 | 11/1961 | Crane | 15/230 |
| 3,990,124 | 11/1976 | MacKay, Jr. et al. | 15/230.12 |
| 4,607,412 | 8/1986 | Ashworth | 15/230 |
| 4,907,313 | 3/1990 | Roeker et al. | 15/98 |
| 5,123,139 | 6/1992 | Leppert et al. | 15/230 |
| 5,138,735 | 8/1992 | Kusz et al. | 15/230 |
| 5,249,329 | 10/1993 | Arnold | 15/230 |

*Primary Examiner*—Edward L. Roberts, Jr.
*Attorney, Agent, or Firm*—Andrus, Sceales, Starke & Sawall

[57] ABSTRACT

A backing plate for a rotary buffing pad assembly provides cushioned support for a pair of curved edge buffing pads mounted back-to-back. The backing plate is adapted for easy reversible mounting and the cushioned pad support prevents damaging contact by the edge of the rigid backing plate with the surface being finished.

8 Claims, 2 Drawing Sheets

FIG. 1
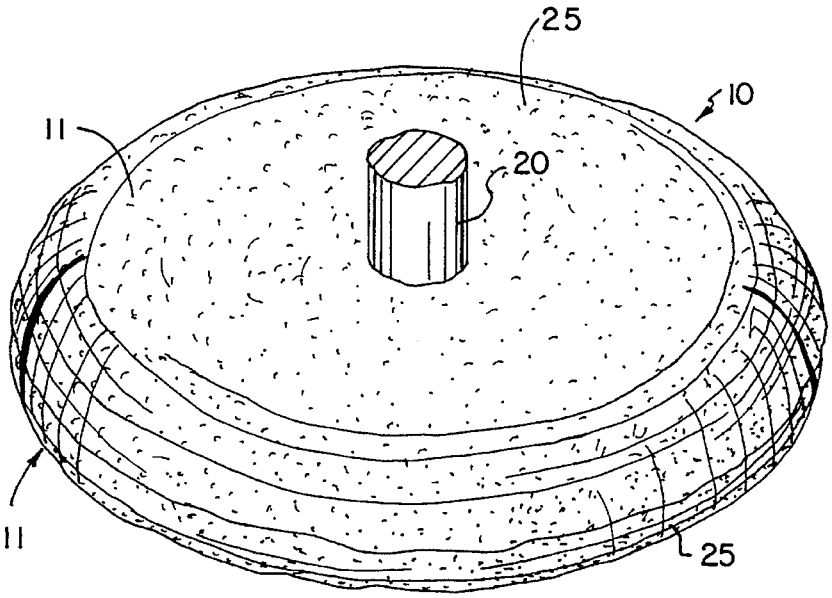
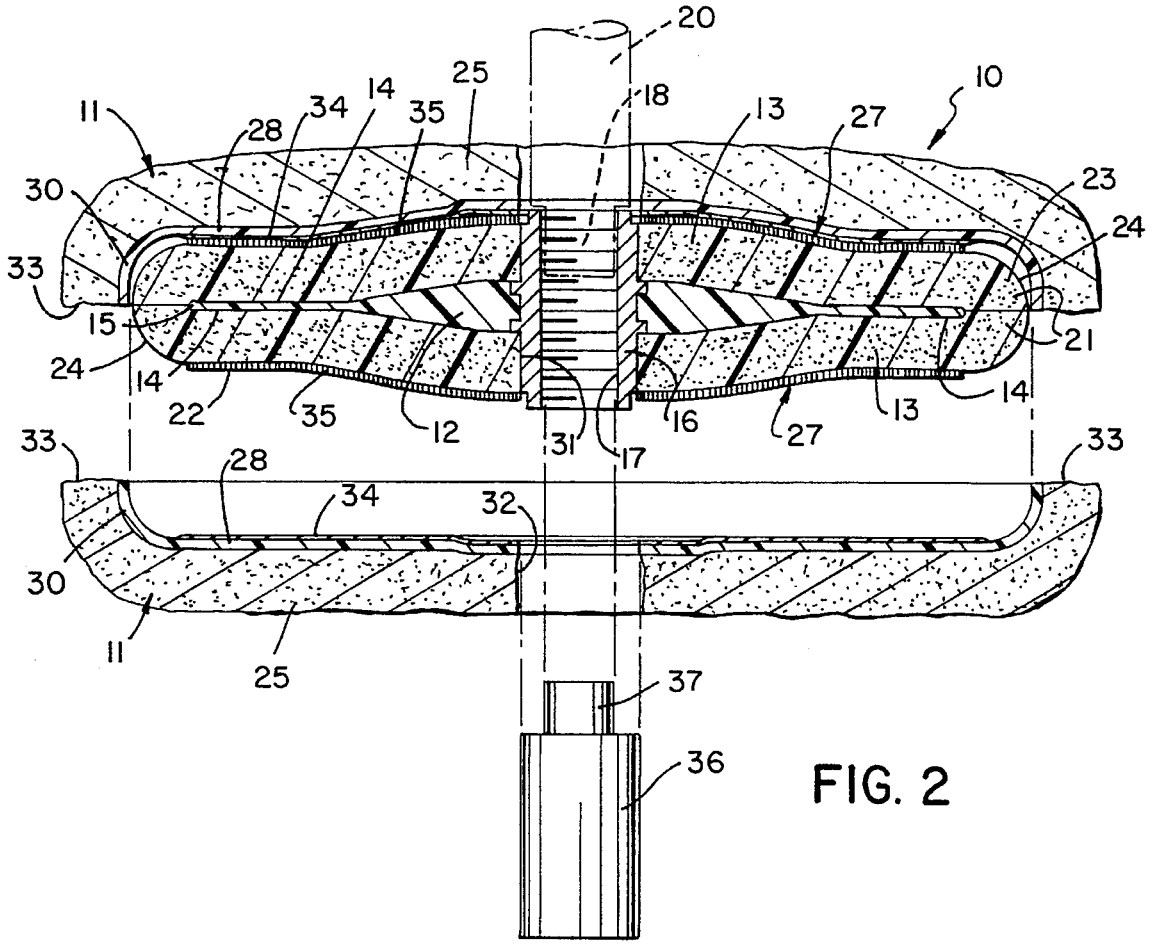
FIG. 2

DOUBLE CURVED BACKING PLATE WITH CUSHIONED SUPPORT FOR ROTARY BUFFING PADS

BACKGROUND OF THE INVENTION

The present invention pertains to rotary buffing pads adapted particularly for use with a power buffer and, more particularly, to a cushioned backing plate assembly for demountable attachment and support of two curved-edge buffing pads.

Rotary buffers are widely used in automotive body finishing and similar operations. Circular buffing pads are typically attached to a rigid circular backing plate which, in turn, is attached by a central hub to the shaft of a rotary power buffer. The buffing media used in buffing pads includes tufted natural wool or synthetic fibers and foam pads made of various synthetic foam materials. Buffing pads may be permanently attached to the backing plate or demountably attached thereto to facilitate replacement without disposal of the backing plate. It is also known to attach identical buffing pads to the opposite faces of a rigid backing plate, thereby allowing the pad assembly to be reversed after the operative face has been rendered unusable to present a fresh buffing face. Such a construction is shown in U.S. Pat. No. 3,990,124.

It is also known to provide easily demountable and replaceable buffing pads which are attached to the backing plate with a fastening system requiring no tools. A most popular fastening system is a hook and loop fastener, one common type of which is sold under the trademark VELCRO. Such a buffing pad assembly is shown in U.S. Pat. No. 5,123,139.

The use of hook and loop fastening systems for demountably attaching two buffing pad halves to the opposite faces of a rigid backing plate is also known, as shown in U.S. Pat. No. 5,249,329. It is also known to provide rotary buffing pads with stiff annular backing members which provide the attachment interface with the backing plate and which backing members may also be provided with curved peripheral edges to which the buffing medium also conforms to provide a curved edge buffing pad. Such curved buffing pads may utilize either tufted fiber or foam buffing medium. A curved edge demountable pad is shown, for example, in U.S. Pat. No. 4,907,313. This patent also discloses a composite backing plate which includes a layer of dense resiliently compressible foam material between the rigid backing plate and the buffing pad.

In both of the reversible double pad assemblies shown in U.S. Pat. Nos. 3,990,124 and 5,249,329, the peripheral edge of the rigid backing plate is positioned directly adjacent the base of the buffing medium which, in the disclosed embodiments in both patents, comprises a conventional tufted fiber material, such as wool. In use, when it is desired to tilt the rotating buffing pad to utilize its peripheral edge for a buffing operation, there is a great likelihood that the application of too much pressure by the operator will result in damaging surface contact by the buffing pad backing material or the edge of the rigid backing plate. This, of course, is highly undesirable and, as a result, the operator must take great care when so using the buffer.

SUMMARY OF THE INVENTION

In accordance with the present invention, a rotary buffing pad assembly utilizes an intermediate cushioning member for curved edge buffing pads. The cushioning member is interposed between the pads and the backing plate to provide cushioned support and to prevent undesirable edge contact of the hard plate edge with the surface being finished.

The cushioning member of the present invention is intended for use in a rotary buffing pad assembly adapted for demountable attachment to the rotary shaft of a powered buffer. The assembly includes a rigid annular backing plate having opposite faces, each of which faces extends between a circular outer edge and a central hub adapted for attachment to the buffer shaft. A buffing pad is operatively attached to each face of the backing plate and each pad includes a stiff annular inner backing member that provides an attachment interface and an outer buffing medium fixed to the backing member. Each backing member has a dish-shape which is defined by a generally flat circular body and a curved peripheral edge, the curved edge causing the adjacent edge portion of the buffing medium to assume a curved shape corresponding to the curved peripheral edge. The improvement of the present invention comprises a flexible circular cushioning member which is attached to the backing plate and has opposite face portions and an outer edge portion which enclose, respectively, the opposite faces and the outer edge of the backing plate. The face portions provide the attachment interface for the buffing pads and the outer edge portion of the cushioning member has a rounded peripheral outer edge surface which defines a smooth transition between the opposite face portions. The outer edge surface conforms to and provides cushioned support for the curved peripheral edges of the backing members. As a result, attachment of the backing members to the respective face portions of the cushioning member places the curved peripheral edges of the backing members in juxtaposition and causes the adjacent edge portions of the respective buffing medium to enclose the cushioning member.

In the preferred embodiment, the buffing pads are demountably attached to the cushioning member and, most preferably, with attachment means comprising co-acting hook and loop fastener material layers secured to the body of the backing member and the face portion of the cushioning member forming each attachment interface.

The cushioning member may be permanently affixed to the backing plate or, alternately, may comprise a pair of identical circular half members each of which is attached to a face of the backing plate. In the last mentioned embodiment, the circular half members may be demountably attached to the backing plate, most preferably by use of co-acting layers of hook and loop fastener material.

The cushioning member preferably comprises a synthetic foam material which, in one particularly preferred embodiment, comprises a neoprene foam.

BRIEF DESCRIPTION OF THE DRAWINGS

FIG. 1 is a perspective view of the buffing pad assembly of the present invention.

FIG. 2 is an exploded sectional side view of the buffing pad assembly shown in FIG. 1.

DETAILED DESCRIPTION OF THE PREFERRED EMBODIMENT

Figure 3:
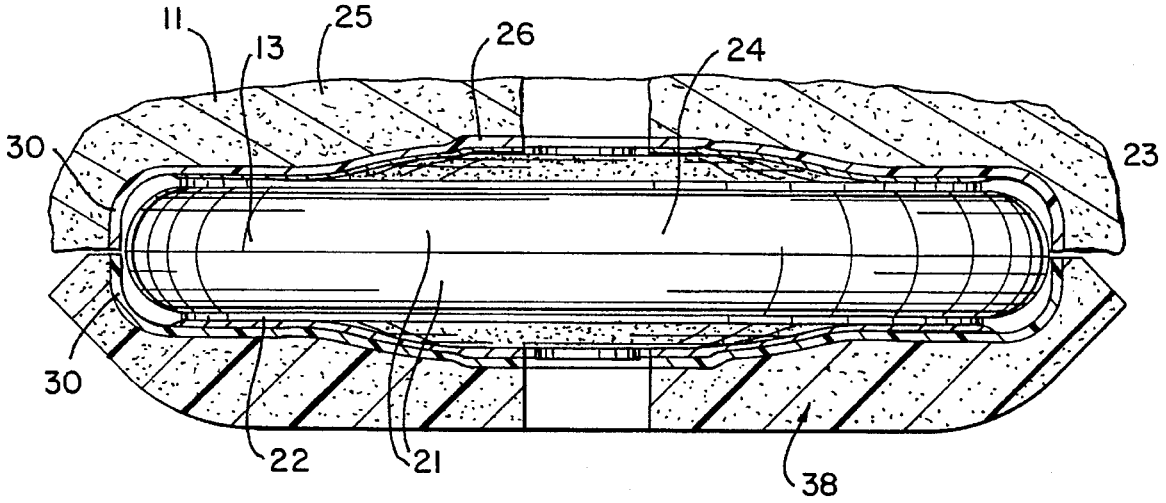
FIG. 3 is a side view of the buffing pad assembly, similar to FIG. 2, showing the use of two buffing pads having different buffing media.

Referring to FIGS. 1 and 2, the buffing pad assembly 10 of the present invention includes two rotary buffing pads 11 supported on a rigid annular backing plate 12 via a flexible circular cushioning member 13. The backing plate 12 is preferably made from a hard rigid thermoplastic material and includes a pair of generally flat faces 14 which extend between a circular outer edge 15 and a central opening in which is positioned a hub 16. The hub is preferably formed separately of aluminum and the backing plate 12 is attached to the hub, as by insert molding. The hub 16 is provided with a threaded through bore 17 by which it may be demountably and reversibly attached to the threaded end 18 of the shaft 20 of a power buffer or to commonly used extension adaptor which interconnects the shaft and the hub to position the buffing pads further from the power buffer. As shown in FIG. 2, the backing plate 12 preferably has a thicker section adjacent the hub which tapers toward the outer edge 15, all in a manner well known in the art.

The cushioning member 13 may be made of a neoprene foam or any other relatively soft resilient synthetic material. The cushioning member is preferably formed in two half sections 21, each of which is adhesively secured to one face 14 of the backing plate 12. The cushioning member may, alternately, be of a unitary construction and, for example, molded directly onto the backing plate 12.

The cushioning member 13 is substantially larger in thickness and diameter than the backing plate 12 and includes opposite outer face portions 22 and an outer edge portion 23 which together completely enclose the backing plate. The outer edge portion 23 of the cushioning member has a rounded peripheral outer edge surface 24 which defines a smooth transition between the outer face portions 22.

The buffing pad 11 may include an outer buffing medium 25 or material of any suitable type which is used and well known in the industry. For example, the buffing medium may comprise natural wool, synthetic fibers, or closed cell synthetic foam. The buffing medium 25 is fixed to a stiff annular backing member 26 and the backing member, in turn, provides the attachment interface 27 between the pad 11 and the cushioning member 13. The backing member 26 may be of any suitable material which is compatible and typically used with the buffing medium 25. Thus, a tufted natural wool buffing medium may utilize a heavy stiff woven fabric backing member, whereas a synthetic buffing medium, either fibrous or foam, may utilize a thermoplastic backing member such as polyethylene, to which the buffing medium may be adhesively attached. In any case, the backing member 26 is of a generally dish-shaped configuration and includes a generally flat circular body 28 and a curved peripheral edge 30. The curved edge 30 is sized and shaped to conform to the rounded outer edge surface 24 of the cushioning member 13. The curvature of the edge of the backing member causes the buffing medium to also assume a curved shape corresponding generally to the curved peripheral edge 30, as shown in the drawings. Thus, when the buffing pads 11 are attached to the cushioning member 13 at their respective attachment interfaces 27, the curved peripheral edges 30 are in juxtaposition (see also FIG. 3) and the adjacent edge portions of the respective buffing media 25 abut one another and essentially enclose the cushioning member 12, as best shown in FIGS. 1 and 3.

Both the cushioning member 13 and the buffing pads 11 are provided with central mounting holes 31 and 32, respectively, allowing these elements to be placed over the central hub 16 and the buffer shaft 20 to pass therethrough.

In use, the double curved edges 30 of the buffing pad backing members 26 are flexible enough to give way if pressure is applied by the operator in a radial direction by bringing the outer edge of the buffing pad assembly into contact with the surface being finished. Such deflection, however, will in turn be supported by the soft resilient material of the underlying cushioning member 13 such that the outer edge 15 of the rigid backing plate 12 will not inadvertently come into contact with the surface being finished. Furthermore, the substantial abutting contact between the edge portions 33 of the buffing media 25 provides a virtually continuous buffing edge as shown in FIG. 1. This is particularly true when using a tufted wool or synthetic fiber buffing medium where the fibers from the two buffing pads 11 mesh and overlap at the abutting edge portions 33.

Each of the buffing pads 11 is preferably demountable attachable to the outer face portion 22 of the cushioning member 13. Demountable attachment is preferably accomplished by utilizing a conventional hook and loop fastening system, one of which types is sold under the trademark VELCRO. Referring particularly to FIG. 2, the circular body 28 of the backing member 26 has a layer of loop fastener material 34 affixed thereto and the outer face portion 22 of the adjacent cushioning member 13 has a cooperating layer of hook fastener material 35 affixed thereto to provide the attachment interface 27. A centering tool 36 may be temporarily inserted through the mounting hole 11 in the buffing pad, and the centering tool includes a pilot nose 37 which is received in the threaded bore 17 of the hub 16 to assure accurate axial centering of the buffing pad as it is attached to the cushioning member. After attachment has been made between the loop and hook layers 34 and 35, the centering tool 36 is withdrawn.

By simply unthreading the mounting hub 16 from the buffer shaft 20, the buffing pad assembly 10 may be reversed and rethreaded onto the buffer shaft to present a clean buffing pad for use. As shown in FIG. 3, one of the buffing pads 11 may be of conventional tufted wool configuration while the other buffing pad 38 may comprise a foam buffing media, allowing the operator to select either of two different buffing media.

Figure 4:
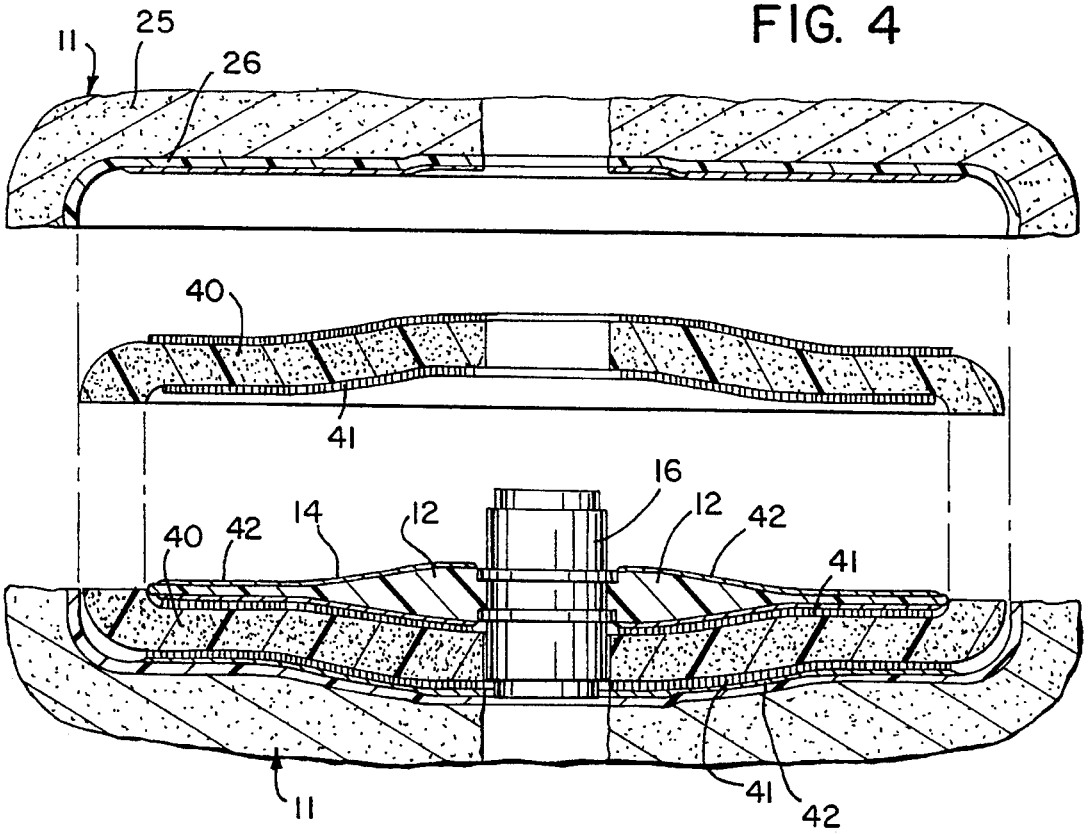
FIG. 4 is an exploded view, similar to FIG. 2, showing an alternate embodiment of the buffing pad assembly.

In FIG. 4, the cushioning member comprises a pair of identical circular half members 40. Each of the half cushioning members is separately attached to one face 14 of the backing plate 12. In this embodiment, each cushioning half member 40 is demountably attached to the backing plate 12 with a hook and loop fastener system similar to that used for demountably attaching the buffing pads to the cushioning member. Thus, the inside surface of each half 40 of the cushioning member has secured thereto a layer of hook fastener material 41. Correspondingly, the face 14 of the backing plate 12 has secured thereto a layer of cooperating loop fastener material 42. The layers are attached in the usual manner with the outer surface of the hub 16 providing a self-centering function for the circular half members 40.

In another variation, the hook and loop fastener system 34,35, used to provide the attachment interface 27 between the buffing pads and the cushioning member, may be eliminated and their attachment made permanent rather than demountable. Thus, the buffing pad backing member 26 may be adhesively attached directly to the outer face portion 22 of the backing member.

I claim:

1. In a rotary buffing pad assembly for demountable attachment to the rotary shaft of a power buffer, said assembly including a rigid annular backing plate having opposite faces, each face extending between a circular outer edge and a central hub for attachment to the buffer shaft, and a buffing pad operatively attached to each face of said backing plate, each pad including a stiff annular inner backing member providing an attachment interface and an outer buffing medium fixed to the backing member, each annular backing member having a dish-shape defined by a generally flat circular body and a curved peripheral edge which edge causes the adjacent edge portion of the buffing medium to assume a curved shape corresponding to said curved peripheral edge, the improvement comprising:

a flexible circular cushioning member attached to the backing plate, said cushioning member having opposite face portions and an outer edge portion enclosing respectively the opposite faces and the outer edge of the backing plate, said face portions providing the attachment interface for the buffing pads, and the outer edge portion of said cushioning member having a rounded peripheral outer edge surface defining a smooth transition between said opposite face portions, said outer edge surface conforming to and providing cushioned support for the curved peripheral edges of the backing members;

whereby attachment of the backing members to the respective face portions of the cushioning member places the curved peripheral edges of the backing members in juxtaposition and causes the adjacent edge portions of the respective buffing media to enclose said cushioning member.

2. The invention as set forth in claim 1 wherein the buffing pads are demountably attached to said cushioning member.

3. The invention as set forth in claim 2 including pad attachment means comprising one of two layers of coacting hook and loop fastener material secured to the body of the backing member and face portion of the cushioning member forming each attachment interface.

4. The invention as set forth in claim 1 wherein said cushioning member is permanently affixed to said backing plate.

5. The invention as set forth in claim 1 wherein said cushioning member comprises a pair of identical circular half members each attached to a face of said backing plate.

6. The invention as set forth in claim 5 including means for demountably attaching each cushioning half members to said backing plate.

7. The invention as set forth in claim 6 wherein said attaching means comprises respective coacting layers of hook and loop fastener material.

8. The invention as set forth in claim 1 wherein said cushioning member comprises a neoprene foam material.

* * * * *